United States Patent [19]

Willitts

[11] 4,430,866

[45] Feb. 14, 1984

[54] PRESSURE CONTROL MEANS FOR REFRIGERATION SYSTEMS OF THE ENERGY CONSERVATION TYPE

[75] Inventor: Benjamin R. Willitts, Lawrenceville, N.J.

[73] Assignee: Emhart Industries, Inc., Farmington, Conn.

[21] Appl. No.: 415,003

[22] Filed: Sep. 7, 1982

[51] Int. Cl.[3] ..... F25B 41/00

[52] U.S. Cl. ..... 62/196.4; 62/509

[58] Field of Search ..... 62/196.4, 509, 196.1, 62/196.2, DIG. 17

[56] References Cited

U.S. PATENT DOCUMENTS

| | | | |
|---|---|---|---|
| Re. 27,522 | 11/1972 | Schenk et al. | 62/196.4 |
| 2,874,550 | 2/1959 | Musson | 62/196.4 |
| 2,954,681 | 10/1960 | McCormack | 62/196.4 |
| 2,963,877 | 12/1960 | Malkoff et al. | 62/196.4 |
| 3,088,292 | 5/1963 | Kocher | 62/196.4 |
| 3,126,715 | 3/1964 | Kocher | 62/151 |
| 3,145,543 | 8/1964 | Miner | 62/149 |
| 3,324,673 | 6/1967 | Lindahl et al. | 62/196.4 |
| 3,389,576 | 6/1968 | Mauer | 62/196.4 |
| 3,427,819 | 2/1969 | Seghetti | 62/196.4 |
| 3,905,202 | 9/1975 | Taft et al. | 62/152 |
| 4,012,921 | 3/1977 | Willitts et al. | 62/151 |
| 4,136,528 | 1/1979 | Vogel et al. | 62/174 |
| 4,231,229 | 11/1980 | Willitts | 62/196.2 |

*Primary Examiner*—Henry C. Yuen
*Assistant Examiner*—Harry Tanner
*Attorney, Agent, or Firm*—Frederick A. Zoda; John J. Kane

[57] ABSTRACT

A refrigerating system of the type used in supermarkets for refrigerating foods merchandised in refrigerated display cases, utilizes a control valve sensitive to pressures in a surge receiver and the liquid line. The valve opens whenever the receiver pressure drops below that of the liquid line more than a predetermined amount, to force hot gas from the compressor discharge line into the receiver. An elevation of the receiver pressure results, until the predetermined pressure differential between the liquid line and the receiver is re-established.

7 Claims, 1 Drawing Figure

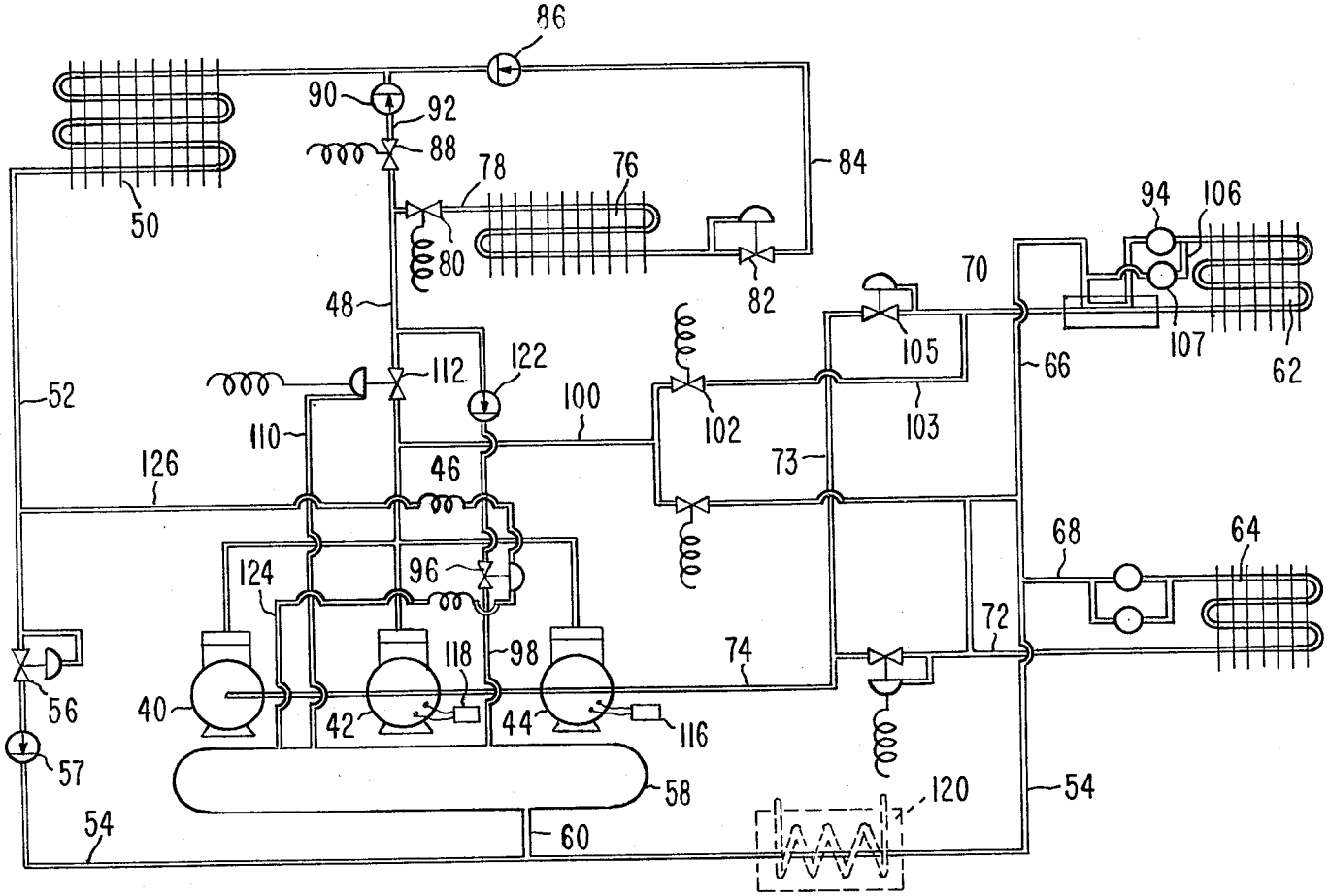
62
64
106
107
94
66
68
54
70
72
105
103
120
84
82
73
74
102
116
58
76
100
60
86
122
98
44
78
80
46
96
118
92
88
112
90
48
42
110
124
40
126
50
52
56
57
54

PRESSURE CONTROL MEANS FOR REFRIGERATION SYSTEMS OF THE ENERGY CONSERVATION TYPE

BACKGROUND OF THE INVENTION

1. Field of the Invention

The present invention relates to those refrigeration systems specially designed for the refrigeration of foods. In a more particular sense the invention relates to systems of this type installed in food supermarkets, and typically incorporating a multiplicity of evaporators cooled by refrigerant flowing in a closed circuit that includes, additionally, a remotely mounted condenser and a series of compressors mounted in parallel.

The invention, in a more specific sense, may be regarded as an improvement in a refrigeration system of the described type in which power savings are effected through subcooling and to perhaps even a greater extent, through lowered head pressures.

In yet a more particular sense, the improvement can be appropriately classified as an automatic control in a refrigeration system of the described type, adapted to cause pressures within a surge receiver to closely follow those of the liquid line as sensed at a location between the condenser and an inlet pressure regulating valve mounted in the liquid line downstream from the condenser.

2. Description of the Prior Art

Refrigeration systems in which the present invention is especially adapted to be incorporated, are disclosed in U.S. Pat. Nos. 3,905,202 to Taft et al; 4,012,921 to Willitts et al; and 4,231,229 also to Willitts.

In U.S. Pat. No. 4,231,229 there is disclosed a refrigerating system in which a receiver pressure control valve is of the differential pressure regulating type, and is sensitive to a difference in pressures between the compressor discharge line and the liquid line. The valve, in these circumstances, operated to communicate the receiver with the compressor discharge line to automatically adjust the receiver pressure to a value that is a function of the pressure differential between the compressor discharge line and the liquid line.

While this arrangement has worked with full efficiency, in most instances, it has been found that in some situations the valve arrangement does not function with full accuracy.

This, it is believed, is due very possibly to the fact that in every installation of a refrigeration system in a supermarket, the specific length and size of the piping used, the location of the condenser, the location and number of the compressors, the environmental conditions, humidity, and the number and location of the refrigerated cases, will differ from other installations. As a result, it is sometimes found that a valve arrangement such as found in U.S. Pat. No. 4,239,229 will operate with full efficiency in the great majority of installations, but will be affected adversely by one or more of the listed factors in the remaining installations in which use of the patented system disclosed in U.S. Pat. No. 4,231,229 is sought.

The present invention has as its main object the provision of a valve arrangement that will be usable to advantage in a fully efficient way, in those situations in which the peculiarities of a particular installation have prevented the arrangement of U.S. Pat. No. 4,231,229 from operating with maximum efficiency.

SUMMARY OF THE INVENTION

In accordance with the present invention, an energy-conserving refrigeration system of the type disclosed in U.S. Pat. No. 4,231,229 utilizes a differential pressure regulating valve sensitive to pressures in the surge receiver and liquid line. More specifically, the valve is connected in a pressure control line extending from the compressor discharge line to the upper portion of the surge receiver, as it is also in U.S. Pat. No. 4,231,229. One of the pressure differential sensing lines of the valve is connected to the liquid line, between the condenser outlet and the inlet pressure regulating valve provided in said line in accordance with any of the above identified patents.

In accordance with the present invention, however, the other pressure differential sensing line is connected not to the compressor discharge line, but rather, to the upper portion of the surge receiver. Differential pressure settings are then effected to produce an optimum relationship between the receiver pressure and the pressure in the liquid line.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

The single FIGURE is a schematic representation of a refrigeration system embodying the present improvement.

DETAILED DESCRIPTION OF THE PREFERRED EMBODIMENT

The disclosures of the above-identified U.S. Pat. Nos. 3,905,202; 4,012,921; and 4,231,229 are hereby incorporated in the present application by reference.

In the single FIGURE of the drawing, there is illustrated a refrigeration system which is like that disclosed in U.S. Pat. No. 3,905,202 issued to Taft et al, or U.S. Pat. No. 4,231,229 issued to Willitts, so far as the basic essentials of such a system are concerned. Accordingly, the present invention has been illustrated as applied to a system like that in FIG. 2, of U.S. Pat. No. 4,231,229, in which by way of example three compressors 40, 42, 44 are connected in parallel with a common gas discharge manifold 46 from which compressed gaseous refrigerant is forced under pressure through a compressor discharge line 48 to condenser 50 positioned to be cooled by ambient air and having a capacity sufficient to condense the entire refrigerant discharged from all three compressors. Condensed liquid refrigerant is forced under pressure from condenser 50 through a liquid line 52 extended at 54 through a modulating pressure responsive valve 56. A check valve 57 is mounted in liquid line 54 downstream from valve 56.

A surge receiver 58 is connected at its bottom to a connecting line 60 extending downwardly to a juncture with liquid line 54. Line 54 continues past receiver 58, and is connected to evaporators 62, 64 through lines 66, 68 respectively. Refrigerant from the evaporators is returned to the compressors through return lines 70, 72, connected to a return manifold 73 extending into communication with the common return header 74 of the several compressors. Not essential to the present invention, but desirable in a typical commercial installation, is a heat reclaim means illustrated in U.S. Pat. No. 4,231,229 as including a heat reclaim coil 76, connected to discharge line 48 through a bypass line 78 and a thermostatically controlled solenoid valve 80. A condenser inlet pressure regulating valve 82 is connected in a line 84 extending from coil 76 to the condenser 50 through a check valve 86, and serves to maintain the desired head pressure in the compressor when the heat reclaim coil 76 is in use. A solenoid valve 88 and check valve 90 are located in section 92 of the compressor discharge line 48 between bypass line 78 and condenser 50. Valve 88 closes when valve 80 is opened, to assure flow of hot gas in series through coil 76 and condenser 50 when the heat reclaim coil is in use.

Valve 56 is adjusted to respond to a predetermined pressure so as to assure the desired condensing pressure in condenser 50 and produce at least partial flooding thereof under outdoor temperature conditions requiring throttling of the valve. This in turn maintains the head pressure of the compressors 40, 42, 44 at a desired operating level, sufficiently high to assure said partial flooding of the condenser at any ambient temperatures below the temperature value to which the valve is pre-set.

Subcooling does not occur until valve 56 begins to cause flooding of the condenser. During heat reclamation, it may be noted, a considerable amount of subcooling does occur.

The refrigerating system disclosed may utilize hot gas as a means for defrosting the evaporators. However, although a hot gas defrost means is illustrated, it is not critical to operation of the improvement comprising the present invention, and is illustrated purely as typical of one type of defrost which can be advantageously utilized with said improvement.

Thus, in the disclosed system, by way of example of a typical defrost means, hot gas from the compressors may be delivered through a hot gas header 46 and branch hot gas line 100 to any evaporators that require defrosting. Thus, when evaporator 62 is to be defrosted solenoid valve 102 in branch 103 of hot gas line 100 is opened to deliver hot refrigerant gas to the line 70, while valve 105 in return line 73 is closed. The hot gas then flows through evaporator 62 in a direction reverse to that in which the expanding gas flows during the refrigerating operation. As a result, the temperature of the coils and fins of the evaporator is elevated, to defrost the evaporator. In the process of defrosting the evaporator, the hot gas is cooled and is at least partially condensed to a liquid. The resulting condensate then flows through bypass line 106 and check valve 107 about the expansion valve 94, and returns through line 66 to the liquid line 54.

In order to assure proper operation of the expansion valves at times when several evaporators are being defrosted at the same time (a situation in which the demand for hot gas from the compressor is so great as to reduce the pressure thereof in line 100), a receiver pressure sensing line 110 is connected to receiver 58 and extends to a regulating valve 112 located in compressor discharge line 48 downstream from the juncture of lines 48 and 100. Valve 112 is normally open but operates to restrict the flow of gas from the compressor through discharge line 48 in the event that the pressure in the discharge line should fall below the desired liquid line pressure. In this event valve 112 tends to close and modulate to increase the compressor head pressure and the pressure applied to the liquid refrigerant within the receiver through pressure control line 98, which in the disclosed embodiment extends from the top of the receiver to a juncture with line 48 downstream from valve 112. An adequate and pre-determined difference in pressure between the hot gas used for defrost purposes and the liquid refrigerant supplied to the evaporators is thus assured under all operating conditions.

Depending upon the ambient temperature to which the condenser 50 is subjected, elements 116, 118 responsive to compressor suction pressures are provided to cycle off one, and sometimes two, of the several compressors.

When abnormally high ambient temperature conditions are encountered, it may sometimes be necessary to resort to the use of an evaporative type sub-cooling device 120. It may be found unessential to successful operation of the system as improved by the present invention but is nevertheless disclosed as an optional device usable in the system.

Also included is a check valve 122 in line 98 upstream from valve 96.

In accordance with the present invention, valve 96 is a differential pressure regulating valve, and utilizes a pressure sensing means preferably in the form of a capillary tube 124 extending into pressure-sensory relationship to the upper portion of surge receiver 58, that is, the gas-confining chamber of the surge receiver defined between the level of the liquid therein and its top wall.

A second capillary tube 126 is provided as a pressure sensing means for the valve 96, and extends therefrom into pressure-sensory relationship to the liquid line 52, between valve 56 and the outlet of the condenser 50.

It should be noted at this point that the arrangement disclosed in U.S. Pat. No. 4,231,229 has been found quite satisfactory in many situations. However, in some situations there has been a tendency toward malfunction. In these circumstances it has been found that valve 96 may be made pressure-sensitive to the locations illustrated in the drawing of the present application, with excellent results.

Operation

With a system including a valve 96 having the pressure-sensitive capillary tubes 124, 126 connected as shown, the installer establishes a pressure differential of approximately 2 psig.

In a typical installation, utilizing R502 refrigerant, in certain situations the valve arrangement shown in U.S. Pat. No. 4,231,229 may permit a pressure drop between the inlet and outlet sides of the condenser (that is, between the compressor discharge line 48 and the liquid line 52) in excess of the designed maximum spring pressure of inlet pressure regulating valve 56. For example, in a heat reclaim mode typical observed pressures were 230 psig in line 48, 205 psig in line 52, 205 psig in the top portion of the receiver, and 35 psig suction pressure in compressor suction line 74. This was observed to open valve 96, closing valve 57, raising the pressure in liquid line 52 between the condenser and valve 56 to within the $\Delta^P$ setting of valve 96, which in this instance might be, for example, one that would normally maintain the drop from the compressor discharge to the liquid line at 2 lbs. or less.

In this situation, valve 57 would be forced closed in the effort to raise the pressure in liquid line 52 above valve 57 (the "drop leg pressure"). This was observed to result in forcing all of the refrigerant out of the receiver, together with hot gas that had been forced into the receiver above the liquid, causing the hot gas to be forced through the liquid line 54 downstream from the receiver.

In another situation, in a normal condenser mode, the following pressures were observed; compressor discharge line pressure, 140 psig; drop leg pressure, 140 psig; receiver pressure 110 psig; and suction pressure 39 psig. Thus, the total high side pressure drop (between line 48 and drop leg 52) was zero. The receiver pressure, however, was 30 lbs. below that of the drop leg. This was observed to cause flash gas in the liquid line 54. Yet, since the total high side pressure drop was within the maximum setting for valve 56 (in this instance 16 lbs.) the valve was satisfied and would not open.

These conditions have been likely to occur during the winter months in areas conducive to light load conditions. Additionally, there has been a tendency on the part of service personnel to become confused, due to difficulty in understanding that the receiver pressure could be equal to or greater than the discharge pressure. Many have been prone to condemn valve 56 for these conditions. The present arrangement obviates these conditions by allowing service personnel to cause valve 56 to create a differential between lines 52 and 54 facilitating the adjustment of valve 96.

Generally, at times when valve 56 would be fully open, the refrigeration load would increase (for example during warm climatic periods) and a pressure drop caused by friction in valves 56 and 57 would enable adjustment of valve 96 for the desired setting.

In the present invention, the types of misfunction discussed above were averted. By locating the pressure-sensing means 124, 126 as illustrated and establishing a pressure differential between drop leg 52 and receiver 58, at for example, 2 psig, it was found that the drop leg pressure would generally follow that of the compressor discharge line, remaining below the discharge line pressure.

At the same time, the receiver pressure would closely follow the drop leg pressure, at all times, and in these circumstances, excellent operational characteristics were obtained.

It may be noted that the arrangement shown in U.S. Pat. No. 4,231,229 works with full efficiency in many installations. However, the specific differences found from one installation to another are thought to produce the noted misfunctions, warranting the present arrangement as an alternative in those special situations.

These differences between installations are often complex and involve interrelated factors such as ventilation of the machine room in which the compressors are located, the remoteness of the condenser, the vertical drop from the condenser to the IPR valve in feet, piping sizes, etc. Accordingly, in those instances in which it has not been found feasible to make valve 96 pressure-sensitive to the drop leg and compressor discharge line, the present arrangement, wherein the valve 96 is sensitive to pressures in the receiver and the drop leg, appears to produce wholly satisfactory results.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What is claimed is:

1. In a refrigeration system including a compressor, a condenser, a surge receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve that controls communication between the discharge line and the receiver through the receiver pressure control line, and that is sensitive to the pressure differential between the liquid line and the receiver to establish and maintain the receiver pressure at a value which is a function of said pressure differential, said differential pressure regulating valve being mounted in the receiver pressure line to control flow therethrough.

2. In a refrigeration system the improvement of claim 1 wherein the pressure maintained by the inlet pressure regulating valve in the liquid line is less than that in the discharge line.

3. In a refrigeration system an improvement according to claims 1 or 2 wherein the receiver pressure established and maintained by the differential pressure regulating valve closely follows but is less than the pressure maintained in the liquid line by the inlet pressure regulating valve.

4. In a refrigeration system an improvement according to claims 1, or 2 wherein the receiver pressure maintained by the differential pressure regulating valve is on the order of approximately 2 psig less than the pressure maintained in the liquid line by the inlet pressure regulating valve.

5. In a refrigeration system including a compressor, a condenser, a surge receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve that controls communication between the discharge line and the receiver through the receiver pressure control line, and that is sensitive to the pressure differential between the liquid line and the receiver to establish and maintain the receiver pressure at a value which is a function of said pressure differential, said differential pressure regulating valve including a pair of pressure-sensing means one extending from the differential pressure regulating valve to a sensing point located on the liquid line between the condenser and the inlet pressure regulating valve, and the other extending from the differential pressure regulating valve to the receiver.

6. In a refrigeration system the improvement of claim 5 wherein the pressure-sensing means are capillary tubes.

7. In a refrigeration system including a compressor, a condenser, a surge receiver, an evaporator, a discharge line extending from the compressor to the condenser, a liquid line extending from the condenser to the evaporator, a connecting line between the liquid line and the receiver, a return line extending from the evaporator to the compressor, an inlet pressure regulating valve in the liquid line adapted to establish and maintain pressures in the liquid and discharge lines at pre-selected, different operating levels, and a receiver pressure control line connected between the compressor discharge line and the receiver, the improvement comprising a differential pressure regulating valve mounted in the receiver pressure control line to control the flow of fluid therethrough from the compressor discharge line to the receiver and including a sensing element extending into a pressure-sensing relationship to the liquid line at a location between the first valve and the condenser, the first valve being adapted to establish and maintain a pressure differential between the discharge and liquid lines in which the discharge line pressure is in excess of that of the liquid line as measured at the sensing location and the second valve being responsive to the differential between the liquid line pressure at the sensing location and the pressure within the surge receiver, to establish and maintain a pressure in the receiver closely approximating the pressure sensed in the liquid line.

* * * * *